US011520368B2

(12) United States Patent
Pinto et al.

(10) Patent No.: US 11,520,368 B2
(45) Date of Patent: Dec. 6, 2022

(54) JOYSTICK FOR A WORK VEHICLE

(71) Applicant: CNH Industrial America LLC, New Holland, PA (US)

(72) Inventors: Massimo Pinto, Chieri (IT); Alberto Campani, Turin (IT); Mario Alessio Dato, Turin (IT)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 17/426,488

(22) PCT Filed: Jan. 27, 2020

(86) PCT No.: PCT/EP2020/051923

§ 371 (c)(1),
(2) Date: Jul. 28, 2021

(87) PCT Pub. No.: WO2020/157003

PCT Pub. Date: Aug. 6, 2020

(65) Prior Publication Data

US 2022/0100224 A1 Mar. 31, 2022

(30) Foreign Application Priority Data

Jan. 28, 2019 (IT) ..... 102019000001217

(51) Int. Cl.

| | |
|---|---|
| ***G05G 25/00*** | (2006.01) |
| ***E02F 9/20*** | (2006.01) |
| ***G05G 9/047*** | (2006.01) |

(52) U.S. Cl.
CPC ..... *G05G 25/00* (2013.01); *E02F 9/2004* (2013.01); *G05G 9/047* (2013.01)

(58) Field of Classification Search
CPC ..... E02F 9/2004; G05G 9/047; G05G 25/00
See application file for complete search history.

(56) References Cited

U.S. PATENT DOCUMENTS

| | | | |
|---|---|---|---|
| 10,077,543 B2 | 9/2018 | Heinzmann et al. | |
| 2013/0061603 A1 | 3/2013 | Li | |

FOREIGN PATENT DOCUMENTS

| | | | |
|---|---|---|---|
| DE | 102012210473 | | 12/2013 |
| DE | 102018127268 | A1 * | 4/2020 |
| EP | 3351691 | | 7/2018 |
| JP | 2004169334 | A * | 6/2004 |
| KR | 20040057436 | A * | 7/2004 |
| KR | 2017039341 | A * | 4/2017 |
| WO | 2014/104417 | | 7/2014 |

OTHER PUBLICATIONS

International Search Report and Written Opinion dated Apr. 6, 2020 for International Application No. PCT/EP2020/051923 (12 pages).

* cited by examiner

*Primary Examiner* — Daniel D Yabut
(74) *Attorney, Agent, or Firm* — Rickard DeMille; Rebecca Henkel

(57) ABSTRACT

A joystick for a work vehicle includes a handle defining an external surface configured to provide grip for an operator of the work vehicle. The joystick includes hydraulic conditioning means configured to allow the passage of a conditioning fluid into joystick to regulate the temperature of handle.

14 Claims, 5 Drawing Sheets

JOYSTICK FOR A WORK VEHICLE

CROSS REFERENCE TO RELATED APPLICATIONS

This application is a U.S. National Stage filing of International Application Ser. No. PCT/EP2020/051923 entitled "IMPROVED JOYSTICK FOR A WORK VEHICLE AND METHOD FOR CONTROLLING THE TEMPERATURE OF SAID JOYSTICK," filed Jan. 27, 2020, which claims priority to Italian Application Serial No. 102019000001217, filed Jan. 28, 2019, each of which is incorporated by reference herein in its entirety for all purposes.

TECHNICAL FIELD

The present invention relates to an improved joystick for a work vehicle, in particular an improved joystick for an excavator.

BACKGROUND OF THE INVENTION

Work vehicles usually comprises joysticks configured to allow the control of different work elements such as blades or booms of this latter.

An example of work vehicle is represented by mini excavators which are machines designed for mainly light application and for a discontinuous work. Typically, an operator climbs on the machine and gets out of this latter very frequently to check the operation area and to discuss with colleagues about dig operations. Because of this reason and to keep the product cost at low level, many similar work machines are equipped with a simple protection structure instead of a real cab. This structure is called "canopy".

When the work machine is equipped with a canopy instead of the cab, the operator compartment is consequently not equipped with any heating system since the operator area protected by the canopy structure is open to the environment. However, in some areas the temperature of environment may be cold and therefore, it is known to provide joystick which can be warmed upon request of the operator; indeed such warming will offer a thermal comfort and benefit to the operators. This latter will perceive a feeling of comfort especially in cold and wet days. In fact, it is frequent that operators do not wear gloves during operations and therefore the adoption of a warming system have the result of a better warm perception and global wellness for the operator.

Usually, joysticks comprise a pair of shells which are manufactured in polymeric materials like ABS, PA, or similar and which are coupled to each other to define a cavity configured to house a solid rod which is configured to operate the electric/hydraulic/pneumatic circuit which control the work element of the work machine.

In view of the above, known heatable joysticks usually comprise electric means installed inside the cavity defined the aforementioned pair of shells. Electric means comprises electric resistance configured to transform electrical energy to thermal energy which is transmitted from the cavity to joystick shells which consequently warm up the surface in contact with the hand of the user, providing thermal comfort improvement to this latter. The temperature can be adjusted through a dedicated controller, and switched on/off on demand.

However, the use of electrical energy is provided by the battery of the vehicle and/or given by the internal combustion engine. Therefore the energy demand of the vehicle is increased and consequently its consumption.

Therefore, the need is felt to provide temperature adjustable joysticks for work machines which at the same time do not increase the fuel/energy consumption of the vehicle.

An aim of the present invention is to satisfy the above mentioned needs in a cost effective and optimized way.

SUMMARY OF THE INVENTION

The aforementioned aim is reached by a joystick and a work vehicle as claimed in the appended set of claims.

BRIEF DESCRIPTION OF DRAWINGS

For a better understanding of the present invention, a preferred embodiment is described in the following, by way of a non-limiting example, with reference to the attached drawings wherein.

DETAILED DESCRIPTION OF THE INVENTION

Figure 1:
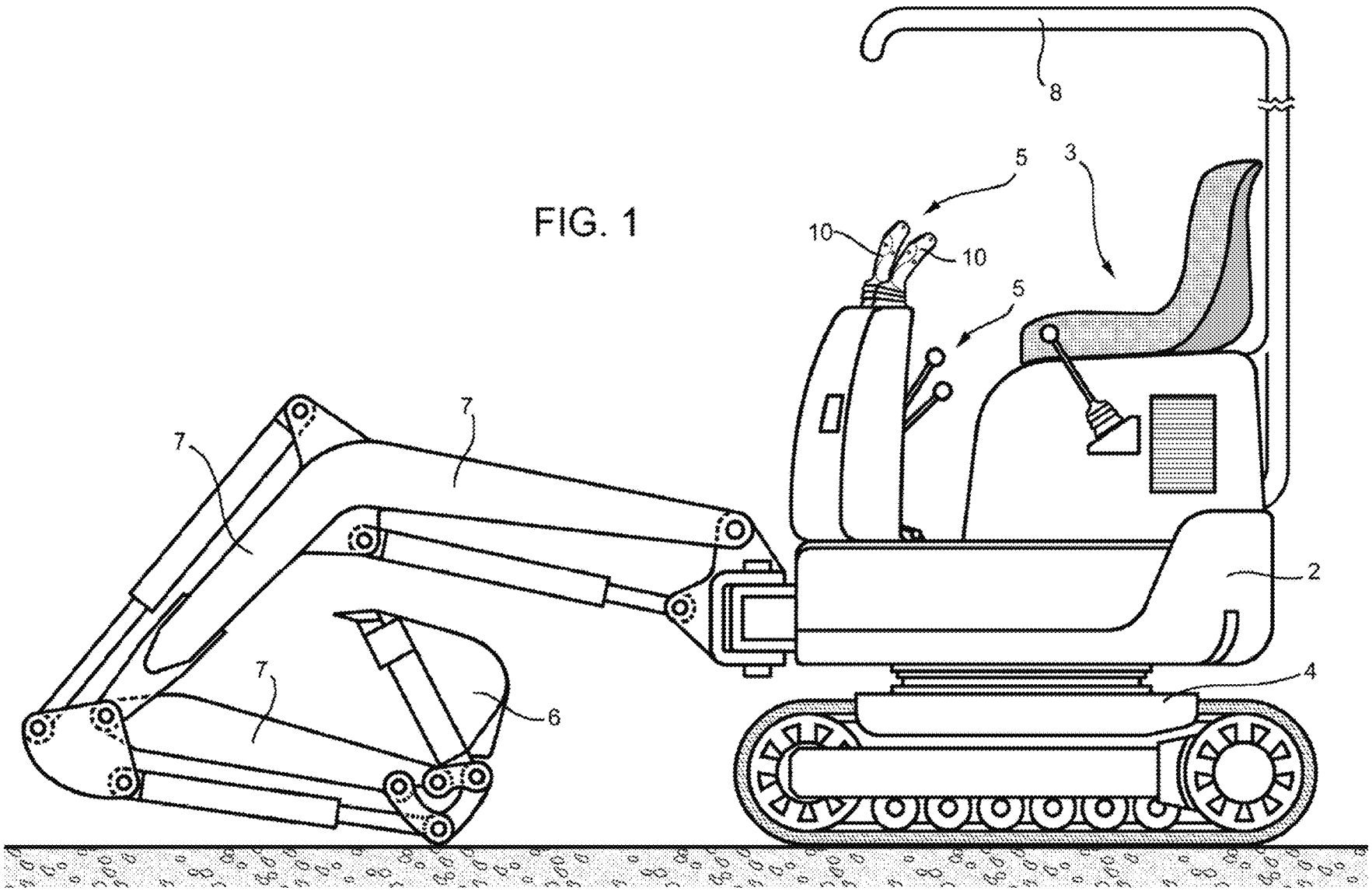
FIG. 1 is a lateral schematic view of a work vehicle comprising a joystick according to the invention.

FIG. 1 discloses a work vehicle, e.g. a mini excavator 1, as known in the art essentially comprising a main body 2 movably carried by an undercarriage 4 movable on the ground, e.g. by tracks. Main body 2 is further provided with an operator station 3 comprising control means 5 for operating a work element, e.g. a bucket 6 carried by a system of booms 7, and being open to the environment. As shown, operator station 3 may further be protected by a canopy 8 extending over operator's seat.

Figure 2:
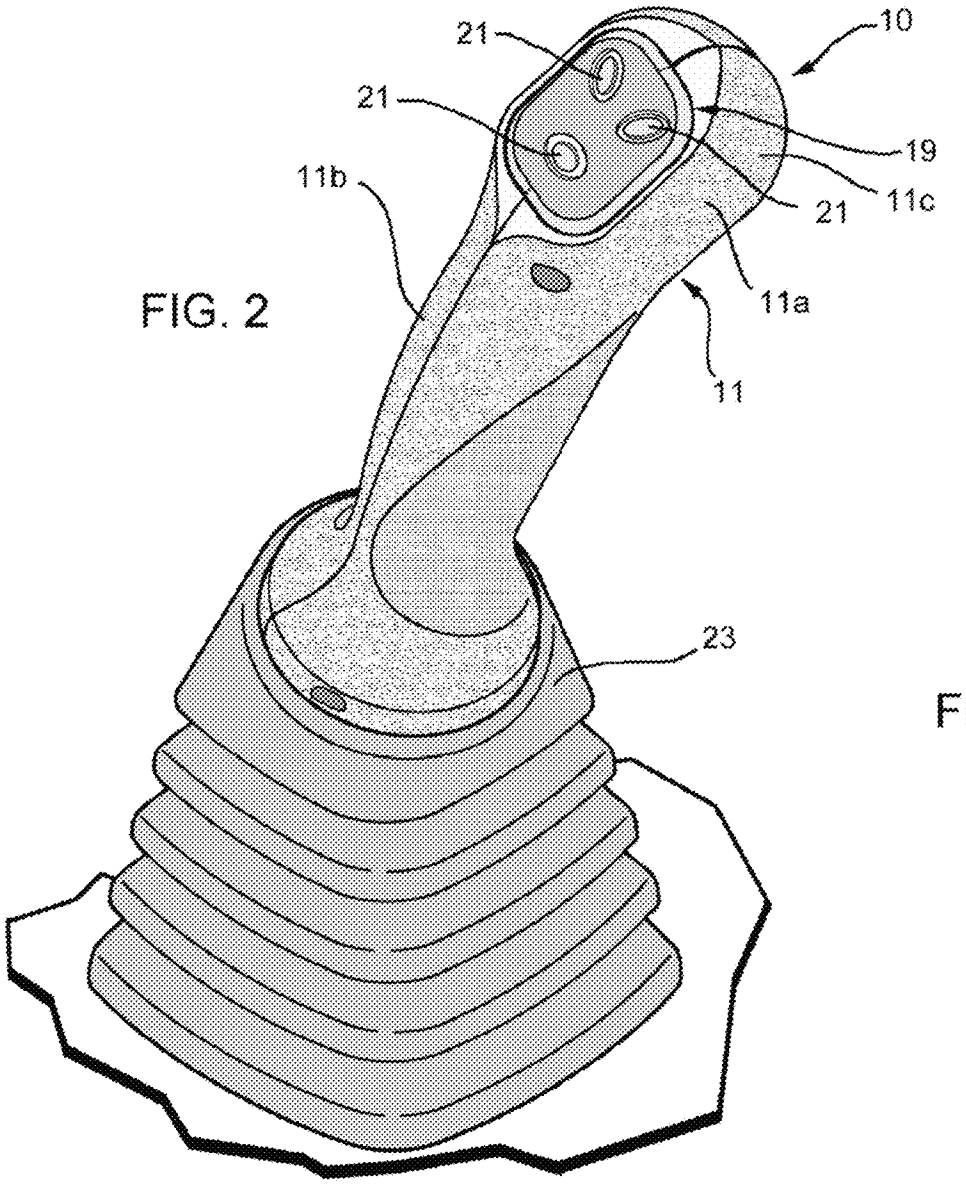
FIG. 2 is a perspective view of a joystick according to the invention.
Figure 4:
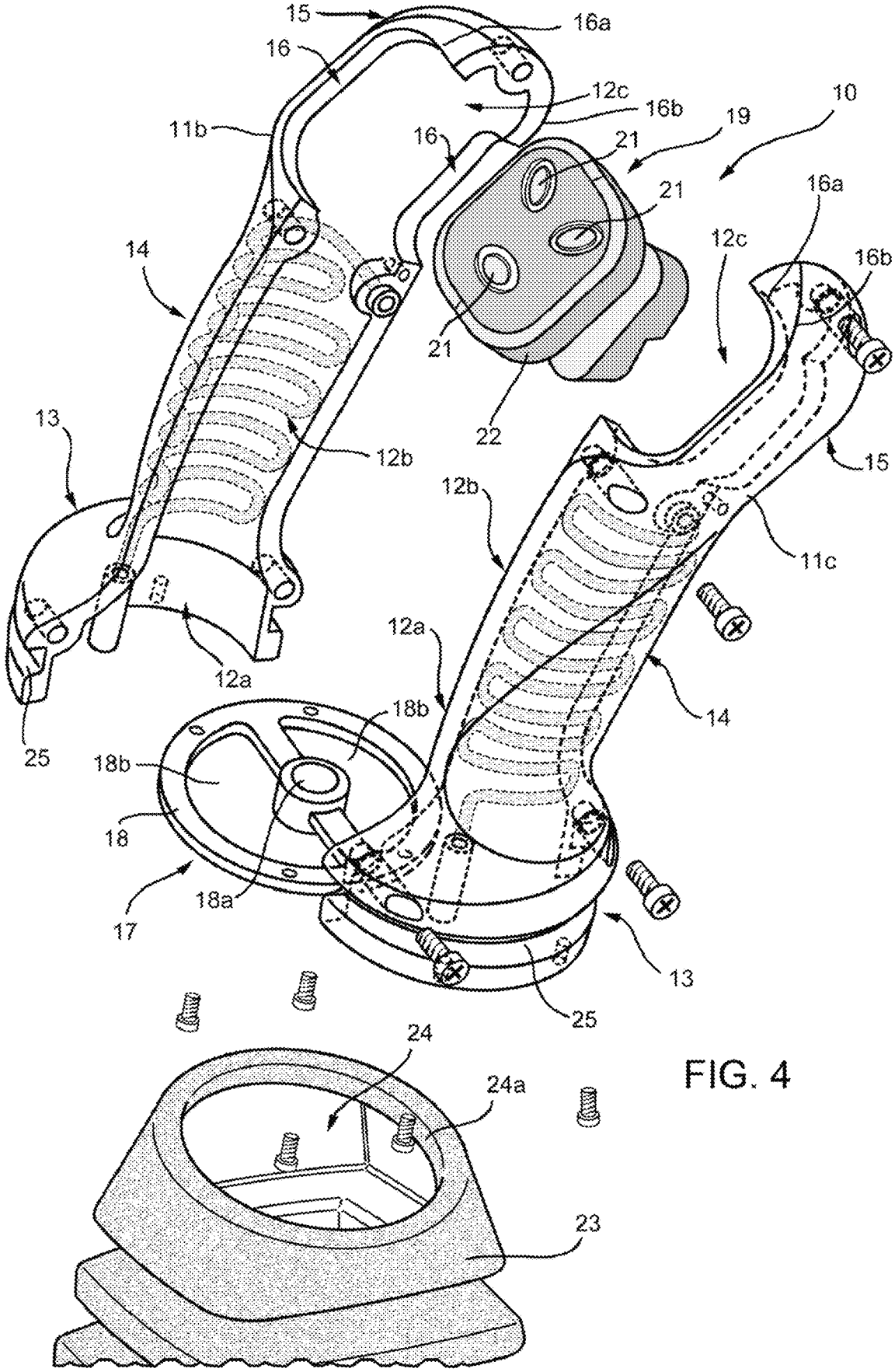
FIG. 4 is a perspective exploded view of the joystick of FIG. 2, with parts removed for sake of clarity.

Control means 5 advantageously comprise at least a joystick 10 according to the invention, disclosed in greater detail in FIGS. 2 and 4.

As known in the art, joystick 10 essentially comprises an handle 11 defining an external surface 11*a* suitable for allowing a comfortable grip for the user. The handle 11 is preferably realized in two shells 11*b*, 11*c* which can be coupled one to the other; more preferably shells 11*b*, 11*c* are hollows and, when connected to each other, define an internal volume 12 as described in the following.

According to the described embodiment, each of shells 11*b*, 11*c* defines a lower portion 13, an intermediate portion 14 and an upper portion 15, preferably fixedly connected one to the other and, more preferably realized monolithically.

Lower portion 13 and intermediate portion 14 have each preferably a semi-cylindrical shape however, intermediate portion 14 has a diameter lower than the diameter of lower portion 13. Upper portion 15 has a substantial semi-ellipsoidal shape and defines a first semi-rectangular opening 16*a* provided with joint corners and a second semi-rectangular opening 16*b* having a shape similar to first semi-rectangular opening 16*b* and preferably centered with respect to this latter; in particular first semi-rectangular opening is realized in a front side of upper portion 15 and second semi-rectangular opening 16*b* is realized in a rear side opposite to the aforementioned front side of upper portion 15.

According to the exemplary shape which has been described above, shells 11*b*, 11*c*, when connected, defines an inner volume 12 comprising a lower volume portion 12*a* which is substantially cylindrical, an intermediate volume portion 12*b* which is substantially cylindrical and has an internal diameter lower than portion 12*a* and an upper volume portion 12*c* which is substantial ellipsoidal and which opened to the environment thanks to a rectangular opening 16.

Lower and intermediate volume portions 12*a*, 12*b* are sized to house a solid rod for controlling the related control circuit (not shown) and/or electrical wires related to such control circuit or simply additional electrical wires.

More preferably, shells 11*b*, 11*c* have a symmetrical shape, defining external handle surface 11*a*, with respect to a sagittal plane passing through handle 11 and they advantageously may be realized in polymeric material. Shells 11*b*, 11*c* may be connected to each other thanks to known means, e.g. threaded means such as screws.

According to the disclosed embodiment, joystick 10 may further comprises guide means 17 configured to control the centering of the above mentioned elements (rod and/or wires) inside volumes 12*a*, 12*b*. In particular, guide means 17 may comprise a support plate 18 being substantially a plate circular disc provided with a central opening 18*a* and at least a circumferential opening 18*b* realized around central opening 18*a*. In the described embodiment, plate 18*a* comprises a central opening 18*a* and a pair of circumferential openings 18*b* each extending for about 180° around opening 18*a* and being consequently one opposed to the other with respect to this latter. According to the above defined configuration, the rod may be housed through opening 18*a* while possible electrical wires may pass through openings 18*b*.

Advantageously joystick 10 may comprises switch means 19 configured to control related circuits, e.g. electrical control circuit for operating bucket 6 or to move body 2 with respect to carriage 3. According to the described embodiment, switch means 19 may comprise a plurality of buttons 21 carried by a support element 22 having a shape complementary to rectangular openings 16*a*, 16*b* and housed inside these latter and upper volume portion 12*c*.

As known in the art, handle 11 may be fixedly connected to a sleeve 23, realized in polymeric elastic material, which is configured to cooperate with lower portions 13 of shells 11*a*, 11*b* to main body 2. In particular, sleeve 23 may be provided with a circular opening 24 having a shape complementary to the shape of lower portions 13 of shells 11*a*, 11*b*. According to the described configuration, each of lower portions 13 of shells 11*a*, 11*b* further defines half of a groove 25 configured to cooperate with an edge 24*a* of opening 24 of sleeve 23 to mechanically connect handle 12 with sleeve 23.

According to the invention, handle 11 comprises hydraulic conditioning means configured to allow the passage of a conditioning liquid fluid into joystick 10 to regulate the temperature of handle 11, i.e. of external surface 11*a*.

In particular, hydraulic conditioning means are configured to fluidly connect joystick 10 with a hydraulic conditioning circuit of the work vehicle 1 so as to spill part of a conditioning fluid of the hydraulic conditioning circuit 31 and make this latter circulate in joystick 10 for regulating the temperature of handle 11.

Figure 3:
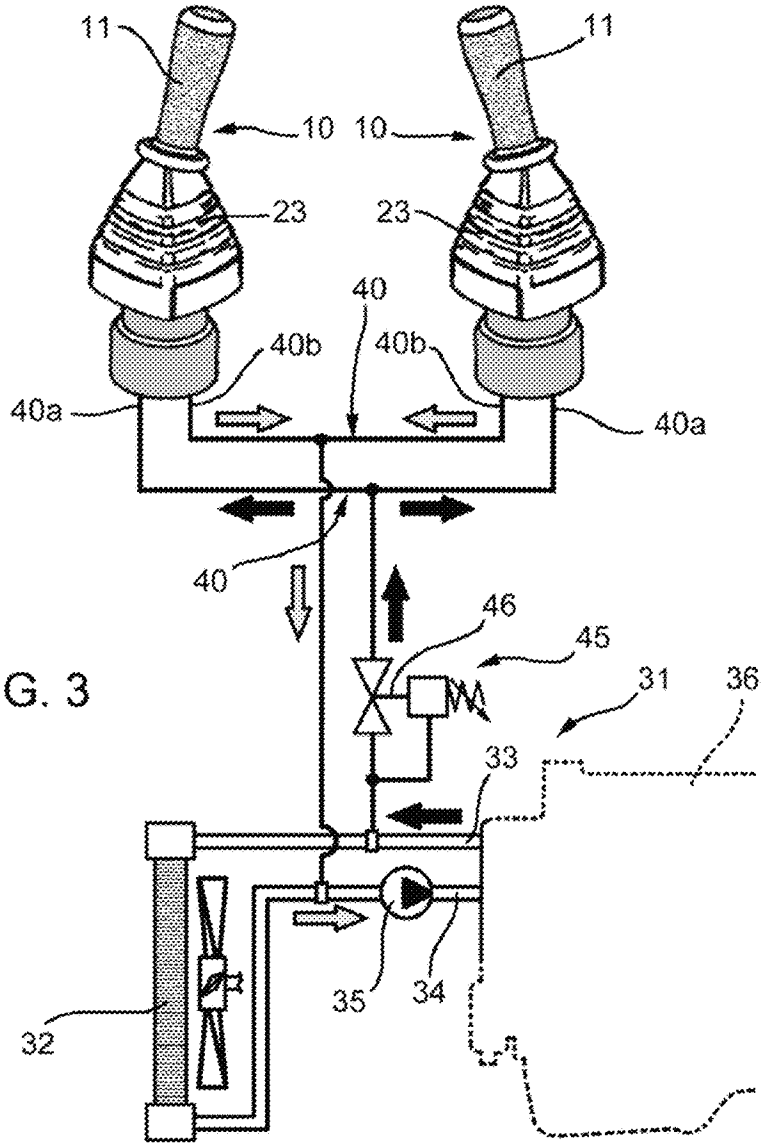
FIG. 3 is a schematic view of an exemplary hydraulic circuit of a work vehicle comprising a joystick according to the invention.

Preferably, as disclosed schematically in FIG. 3, hydraulic condition means advantageously define a fluid connection between joystick 10 and engine cooling fluid of a an engine circuit 31 of vehicle 1. In this way, hydraulic condition means are configured to heat handle 11 so as to reach a temperature above a preset value.

As known, an engine cooling circuit 31 essentially comprises a radiator 32, a first conduit 33 and a second conduit 34 fluidly connecting respectively an internal combustion engine 36 of the vehicle with radiator 3 upstream to this latter and radiator 3 with engine 36 upstream to this latter, and a pump 35 configured to allow the circulation of coolant fluid from engine 36 to radiator 3 and to radiator 3 to engine 36. As known, coolant fluid will heat in engine 36, passes through conduit 33 to radiator 32 in which it is cooled and then through conduit 34 to engine 36 to cool this latter and heat itself.

According to the above, hydraulic conditioning means comprises a system of conduit 40 carried by joystick 10 and fluidly connected to engine cooling circuit 31 so as to spill part of heated cooling fluid of engine 36 to heat handle 11. In particular, system of conduit 40 comprises a first opening 40*a* fluidly connected to first conduit 33 and a second opening 40*b* fluidly connected to second conduit 34. Advantageously, as shown in FIGS. 4 to 8, conduits 40 are housed in handle 11, i.e. in shells 11*b*, 11*c*.

Figure 5:
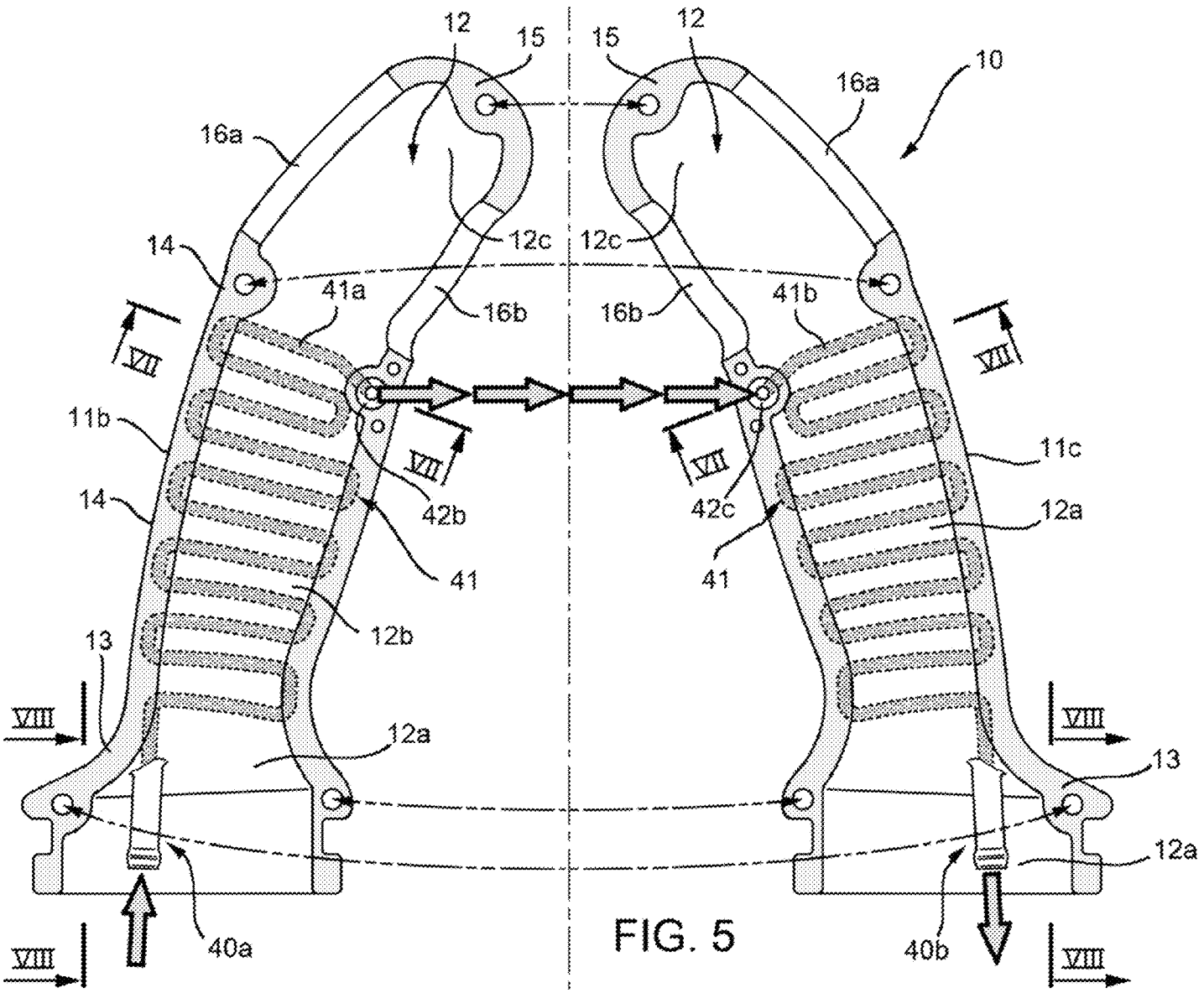
FIG. 5 is a lateral exploded view of part of the joystick of FIG. 2, with parts removed for sake of clarity.
Figure 6:
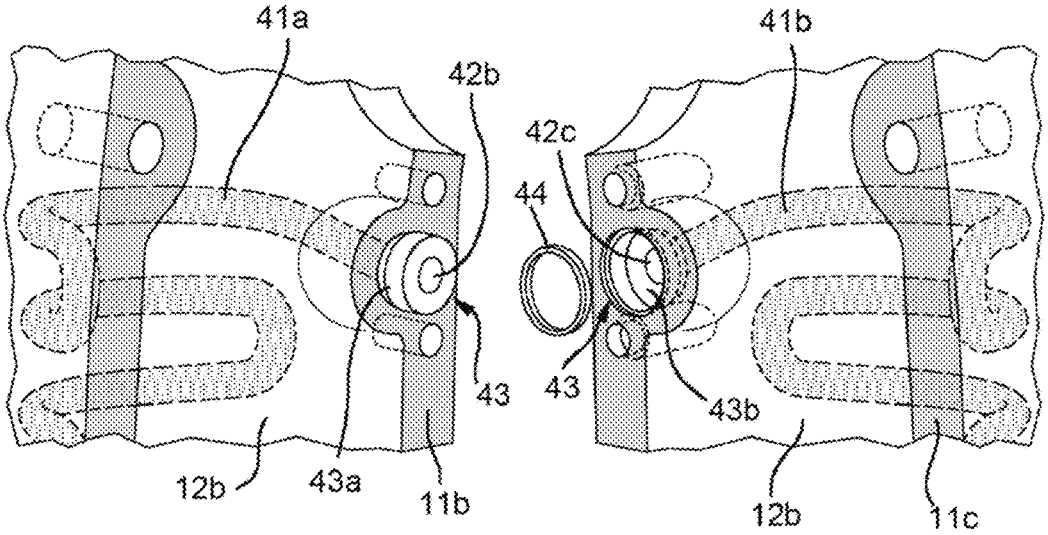
FIG. 6 is a perspective partial exploded view of part of the joystick of FIG. 5.
Figure 7:
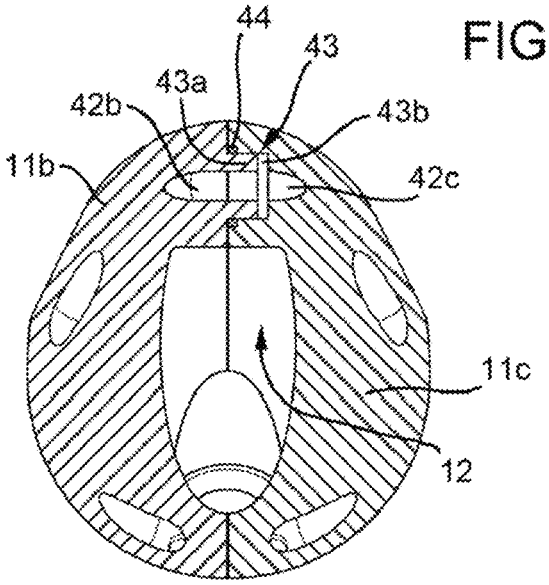
FIG. 7 is a transversal section view of the joystick of FIG. 5 from lines VII-VII.
Figure 8:
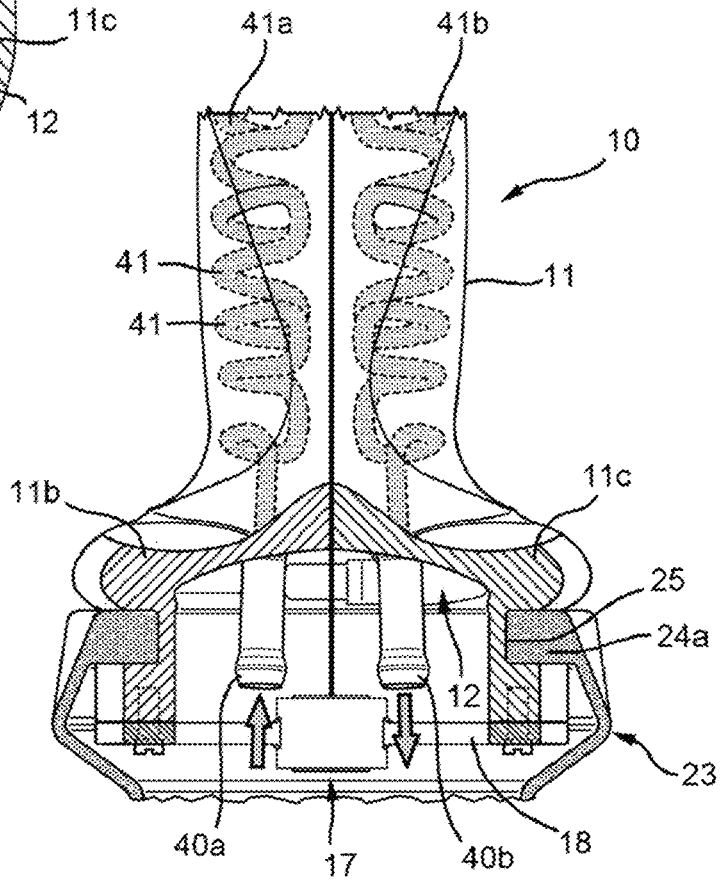
FIG. 8 is a partial rear section view of the joystick of FIG. 5 from lines VIII-VIII.

Advantageously, as shown in FIGS. 5 and 8, first opening 40*a* is realized in one of shells 11*b*, 11*c* and second opening 40*b* is realized in the other of shells 11*b*, 11*c* and conduits 40 comprises a single conduit 41 comprising a first portion 41*a* realized in one of shells 11*b*,11*c* and a second portion 41*b* realized in the other shell 11*b*, 11*c*.

Shells 11*b*, 11*c* each comprises (see FIGS. 5 and 6) an opening 42*b*, 42*c* configured to allow, when shells 11*b* 11*c* are connected, the fluidic communication between first and second portions 41*a*, 41*b* of conduit 31. In particular openings 42*b*, 42*c* may be realized in a lateral edge of respective shells 11*b*, 11*c* and may comprise coupling means 43 configured to allow their matching. In particular, as shown in detail in FIGS. 6 and 7, shell 11*b* may comprise a male coupling means 43, i.e. a protrusion 43*a* and shell 11*c* may comprise a female coupling means 43, i.e. a complementary shape seat 43*b*. Coupling means 43 may further comprises tight means 44, such as an O-ring.

Preferably portions 41*a*, 41*b* of conduit 41 are realized in intermediate portion 14 of shells lib, 11*c* and may have a geometry realizing a plurality of "U" laterally adjacent one to the other along a longitudinal axis of intermediate portion 14 and being placed so that they are one opposite to the other, realizing, when seen laterally, a sort of continuous "S" shape, i.e. a "zig-zag" shape, as clearly depicted in FIG. 5.

Because of the above described complicated shape, conduit 41 may be realized in shells 11*b*, 11*c* thanks to an additive manufacturing process.

Advantageously conduit 41 extends in shells 11*b*, 11*c* of at least two times with respect to the longitudinal extension of intermediate portion 14 and has a diameter which is about half of the thickness of shell 11*b*, 11*c* and extends circumferentially around almost all the extension of the respective shell 11*b*, 11*c*.

According to a further aspect of the invention, one between joystick 10 or circuit 31 may further comprise flow regulation means 45 configured to regulate the flow of conditioning fluid passing in joystick 10 so as to variably regulate the temperature of handle 11 according to the desire of the operator.

Advantageously, flow regulation means 45 comprise a thermostatic adjusting valve 46 configured to regulate the flow of fluid passing from first conduit 33 to opening 40*a*. Preferably, thermostatic adjusting valve 46 may be an electro-actuated valve and vehicle 1 may comprise control means (not shown) e.g. a switch or a button, electrically connected to a control unit (not shown), e.g. the ECU of vehicle 1, electrically connected to valve 46 and configured to regulate the flow which may flow through this latter. In particular control unit comprises elaboration means configured to run code means suitable for operating a control method as described below. More preferably control means may be buttons 21 carried by support 22 placed in upper portion 15 of handle 11.

Alternatively thermostatic adjusting valve 46 may be a mechanically actuated valve operated by a mechanical command linked to said switch or button.

The operation of a joystick 10 as described above is the following.

When the operator activates mechanically or electronically the warming function of joystick 10, flow regulation means 45 allows the passage of a preset flow to joystick 10.

Making reference to hydraulic scheme shown in FIG. 3, heated engine cooling fluid coming from engine 36 will therefore flow towards opening 40*a* of joystick 10 and then pass into handle 11 in particular through first portion 41*a* of conduit 41, through openings 42*b*, 42*c*, through second portion 41*b* of portion 41 and opening 40*b* of joystick 10. When flow out from joystick 10 engine cooling fluid will flow to second conduit 34, downstream with respect radiator 32 and then again into engine 36, forced by pump 35.

The passage of heated engine cooling fluid into conduit inside handle 11 will transmit thermal energy through shells 11*b*, 11*c* thereby increasing the temperature of handle 11 so that when the operator touch surface 11*a* he will perceive a comfortable temperature.

If the operator wants a hotter handle 11 it will be sufficient to regulate the flow of fluid through regulation means 45, i.e. electronically or mechanically.

The present invention further relates to a method for controlling the temperature of a handle of a joystick as described above and comprising essentially the following steps:

- detecting that the temperature of the outer surface 11*a* of handle 11 of joystick 10 is lower than a preset temperature threshold;
- allow the passage of a flow of a conditioning fluid of a conditioning circuit of the work vehicle inside joystick 10; and
- maintain the passage of such flow till the temperature of the outer surface 11*a* of the handle 11 of joystick 10 reaches the preset temperature threshold, then stop the fluid flow into joystick 10.

The reach of the preset temperature may be detected thanks to the use of temperature sensors (not shown) carried by joystick 10 or estimated proportionally to the flow passing through flow regulation means 45.

In view of the foregoing, the advantages of a joystick 10 according to the invention are apparent.

Thanks to hydraulic conditioning means it is possible to control the temperature of handle 11, in particular to heat this latter, taking advantage of the thermal energy of a conditioning fluid of a conditioning circuit already present in the vehicle, thereby avoiding energy waste due to known Joule-effect electrical conditioning means.

Moreover, thanks to the peculiar geometry of conduit 41, which can be obtained economically thanks to additive manufacturing, it is possible to define an optimized profile of conduit 41 inside handle 11 so as to generate a comfortable heating of handle surface 11*a*.

The incorporation of conduit 41 inside shells 11*b*, 11*c* allows to have a light, economical and compact joystick reducing waste of material. The use of additive manufacturing further optimize the production of this latter and allows the creation of conduits 41 of any desired geometry according to the shape of handle 11.

Further, flow regulation means 45 allow to regulate the temperature of handle 11 according to operator's desires.

It is clear that modifications can be made to the described joystick 10 which do not extend beyond the scope of protection defined by the claims.

As said, hydraulic conditioning means may be provided to heat or cool handle 11 or even to both these functions according to operator's necessity.

Moreover it is clear that the shape of components of joystick 10 and number of this latter in the vehicle can be varied.

Further, it is clear the hydraulic circuit 31 as described may be any conditioning circuit of the vehicle comprising different elements.

Conduit 41 may comprise different shapes and hydraulic conditioning means may comprise a plurality of conduits instead of a single one.

The invention claimed is:

1. A joystick for a work vehicle, the joystick comprising:

a handle defining an external surface configured to provide grip by an operator of the work vehicle; and hydraulic conditioning means configured to allow the passage of a conditioning fluid into the joystick to regulate the temperature of the handle;

wherein the hydraulic conditioning means are configured to fluidly connect the joystick with a hydraulic conditioning circuit of the work vehicle so as to spill part of a conditioning fluid of the hydraulic conditioning circuit and make this latter circulate in the joystick for regulating the temperature of the handle.

2. The joystick according to claim 1, wherein the hydraulic conditioning means comprises a system of conduit comprising at least a conduit comprising a first and a second openings configured to fluidly connect the at least one conduit to the hydraulic conditioning circuit of the work vehicle.

3. The joystick according to claim 2, wherein the at least a conduit is carried by the handle.

4. The joystick according to claim 1, wherein the handle comprises at least a shell defining an inner volume.

5. The joystick according to claim 4, wherein the at least a conduit is realized inside the at least one shell.

6. The joystick according to claim 5, wherein the at least a conduit and the at least one shell are realized monolithically.

7. The joystick according to any claim from 5, wherein the at least a conduit and the at least one shell are realized by an additive manufacturing process.

8. The joystick according to any claim from 5, wherein the at least a conduit has a "zig-zag" shape.

9. The joystick according to any claim from 5, wherein the handle comprises two shells coupled one to the other and wherein the conduit is a single conduit and comprises a first portion extending between the first opening to a first intermediate opening in a first of the two shells and a second portion extending between a second intermediate opening to the second opening in a second of the two shells.

10. A work vehicle comprising:

a conditioning circuit configured to use a conditioning fluid for maintaining the temperature of a portion of the vehicle within a preset temperature; and a joystick according to claim 1.

11. The work vehicle according to claim 10, wherein the circuit further comprises flow regulation means configured to regulate the flow of conditioning fluid passing into the joystick.

12. The work vehicle according to claim 11, further comprising an electronic control unit and wherein the flow regulation means comprise an electro-actuated valve, the electronic control unit being configured to operate valve on the base of the desired temperature and a measured or estimated temperature of the handle.

13. The work vehicle according to claim 11, wherein the flow regulation means comprise a mechanically actuated valve.

14. A method for controlling the temperature of the handle of the joystick according to claim 1, the handle comprising an outer surface, the method comprising:

detecting that the temperature of the outer surface of handle of the joystick is lower than a preset temperature threshold;

allowing the passage of a flow of the conditioning fluid of the conditioning circuit of the work vehicle inside joystick; maintaining the passage of such flow until the temperature of the outer surface of the handle of joystick reaches the preset temperature threshold; and in response to the temperature of the outer surface of the handle reaching the present temperature threshold, stopping the fluid flow into joystick.

* * * * *